US011684139B2

(12) United States Patent
Forgrave

(10) Patent No.: US 11,684,139 B2
(45) Date of Patent: Jun. 27, 2023

(54) STRAP ARRANGEMENT FOR A PORTABLE COLLAPSIBLE CHAIR

(71) Applicant: Global Family Brands, LLC, Indianapolis, IN (US)

(72) Inventor: Jeffrey Forgrave, Indianapolis, IN (US)

(73) Assignee: Global Family Brands, LLC, Indianapolis, IN (US)

( * ) Notice: Subject to any disclaimer, the term of this patent is extended or adjusted under 35 U.S.C. 154(b) by 358 days.

(21) Appl. No.: 17/015,834

(22) Filed: Sep. 9, 2020

(65) Prior Publication Data

US 2021/0204680 A1 Jul. 8, 2021

Related U.S. Application Data

(60) Provisional application No. 62/956,851, filed on Jan. 3, 2020.

(51) Int. Cl.
*A45F 3/14* (2006.01)
*A47C 4/28* (2006.01)

(52) U.S. Cl.
CPC ..... *A45F 3/14* (2013.01); *A47C 4/286* (2013.01); *A45F 2003/142* (2013.01)

(58) Field of Classification Search
CPC ..... A45F 3/14; A45F 2003/142; A47C 4/286
See application file for complete search history.

(56) References Cited

U.S. PATENT DOCUMENTS 2,908,522 A * 10/1959 Glave ..... E05C 17/36 292/DIG. 43
5,593,077 A * 1/1997 Izzo ..... A63B 55/00 224/580
5,936,173 A * 8/1999 Tonon ..... G10G 5/005 84/327
7,717,503 B1 * 5/2010 Watson ..... A47C 4/286 297/16.2
2009/0084245 A1 * 4/2009 Harbaugh ..... G10G 5/005 84/327
2016/0051054 A1 * 2/2016 Choi ..... A47C 4/52 297/4
2017/0266521 A1 * 9/2017 Howard ..... A63B 55/408
2019/0045908 A1 * 2/2019 Zhu ..... A45F 3/14

FOREIGN PATENT DOCUMENTS

DE 202006001888 U1 * 6/2006 ..... A45F 3/14

* cited by examiner

*Primary Examiner* — Milton Nelson, Jr.
(74) *Attorney, Agent, or Firm* — Maginot, Moore & Beck LLP

(57) ABSTRACT

A strap arrangement for a collapsible chair includes a first coupling arrangement configured to fixedly attach to a first rear upright of the collapsible chair, a second coupling arrangement configured to fixedly attach to a second rear upright of the collapsible chair, a third coupling arrangement configured to attach to the second rear upright, and a strap having a first end attached to the first coupling arrangement, a second end attached to the second coupling arrangement, and an intermediate portion that passes through and is slidable relative to the third coupling arrangement.

18 Claims, 7 Drawing Sheets

STRAP ARRANGEMENT FOR A PORTABLE COLLAPSIBLE CHAIR

This application claims the benefit of U.S. Provisional Patent Application Ser. No. 62/956,851, filed Jan. 3, 2020, the contents of which are incorporated herein by reference in their entirety.

FIELD

The present invention relates generally to collapsible, portable chairs.

BACKGROUND

Collapsible portable chairs have enjoyed widespread popularity because of their combination of strength, lightweight design, and portable nature. One common design has a metal (e.g. aluminum) frame and a strong fabric seat, back and arm element that fits over the frame. The legs are formed by cross-linkages that collapse inward in width and depth to form a compact structure having a length comparable to the height of the chair, but with a substantially reduced width and height. Such a chair often is paired with an elongate, specially fitted cloth bag or sack into which the chair in the collapsed state can fit. The storage and transport bag often includes a shoulder strap.

Chairs of this type are well-known. Such chairs are often referred to as camping chairs, but enjoy use at any outdoor event that does not include sufficient available seating. Such outdoor events can include parades, outdoor community events, children's sporting events, and the like.

One drawback to the current design of such chairs is the inconvenience of having to fit the collapsed chair into the carrying bag. In general, the cushion portion collapses with the frame, but the bulkiness of the cushion can make placement into the carrying bag moderately inconvenient. This can be magnified if the user intends to move seating positions multiple times at a large venue for a single event (or multiple related events). For example, a user may wish to move to different locations of a little league baseball facility or soccer facility to watch multiple games.

There is a need, therefore, for a collapsible, transportable chair that avoids the inconveniences discussed above.

SUMMARY

The present invention addresses the above-stated needs, as well as others, by providing a collapsible foldable chair having a strap affixed to the frame of the chair that can adjust for carrying the chair when in the collapsed state.

In one embodiment, a strap arrangement for a collapsible chair includes a first coupling arrangement configured to fixedly attach to a first rear upright of the collapsible chair, a second coupling arrangement configured to fixedly attach to a second rear upright of the collapsible chair, a third coupling arrangement configured to attach to the second rear upright, and a strap having a first end attached to the first coupling arrangement, a second end attached to the second coupling arrangement, and an intermediate portion that passes through and is slidable relative to the third coupling arrangement.

In another embodiment, a collapsible chair includes a collapsible frame having a first rear upright and a second rear upright. The collapsible chair further includes a strap arrangement that comprises a first coupling arrangement fixedly attached to the first rear upright, a second coupling arrangement fixedly attached to the second rear upright, a third coupling arrangement attached to the second rear upright, and a strap having a first end attached to the first coupling arrangement, a second end attached to the second coupling arrangement, and an intermediate portion that passes through and is slidable relative to the third coupling arrangement.

The above-described features and advantages, as well as others, will become more readily apparent to those of ordinary skill in the art by reference to the following detailed description and accompanying drawings.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
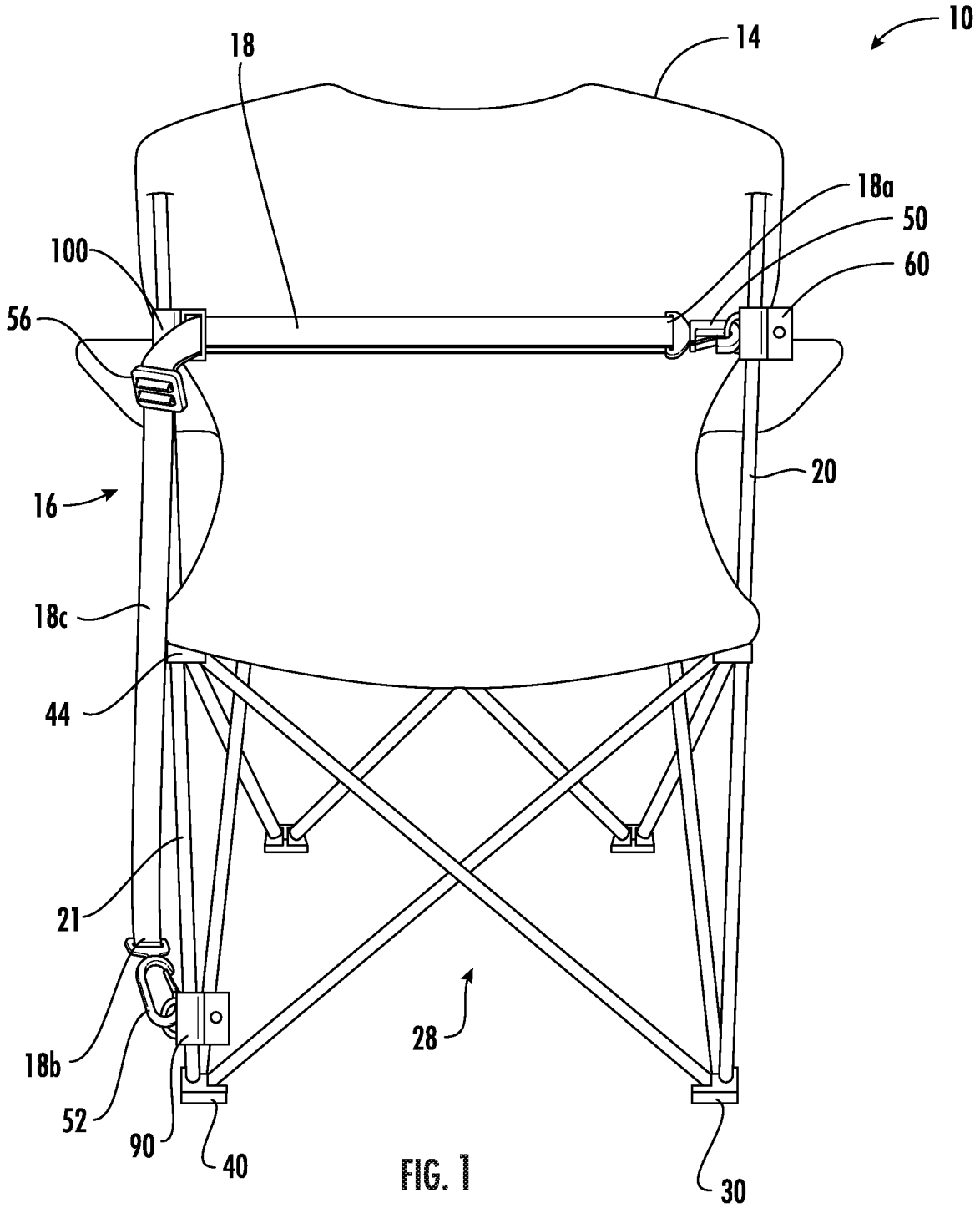
FIG. 1 is a rear view of a collapsible chair in the expanded state and which has a strap arrangement according to the disclosure.
Figure 2:
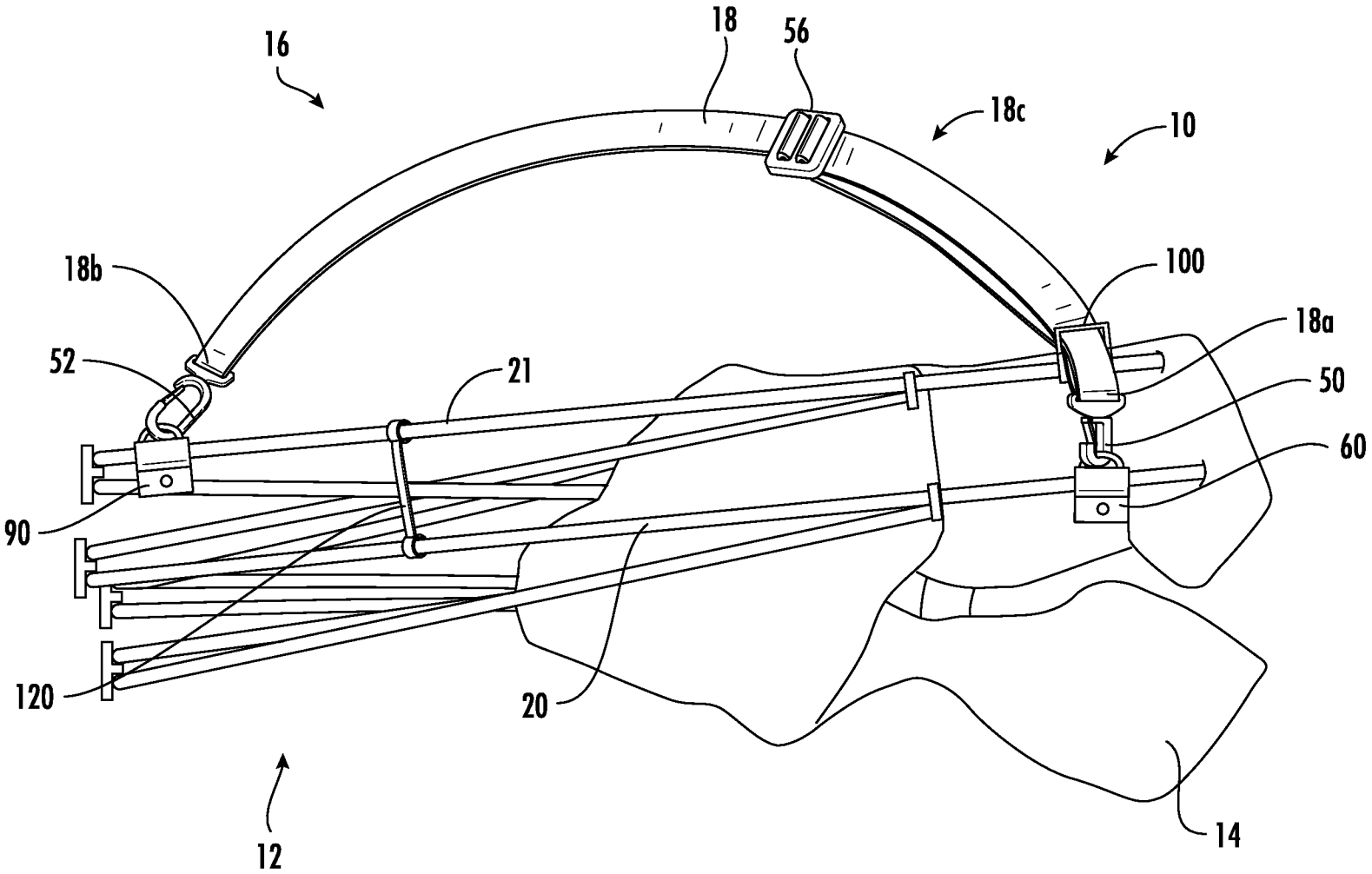
FIG. 2 is a rear view of the collapsible chair of FIG. 1 in the collapsed state with the strap arrangement configured for carrying the chair.

FIG. 1 shows a rear view of a collapsible, portable chair 10 according to one embodiment of the invention in the open or expanded position for use as a chair. FIG. 2 shows a side view of the chair 10 of FIG. 1 in the collapsed or closed position for transport. Referring to FIGS. 1 and 2, the collapsible, portable chair 10 includes a tubular metal frame 12, a cushion fabric element 14, and a strap arrangement 16. The chair 10 in the collapsed state may be placed into a suitable chair bag, not shown, but would be known to those of ordinary skill in the art for containing collapsed portable chairs.

Figure 3:
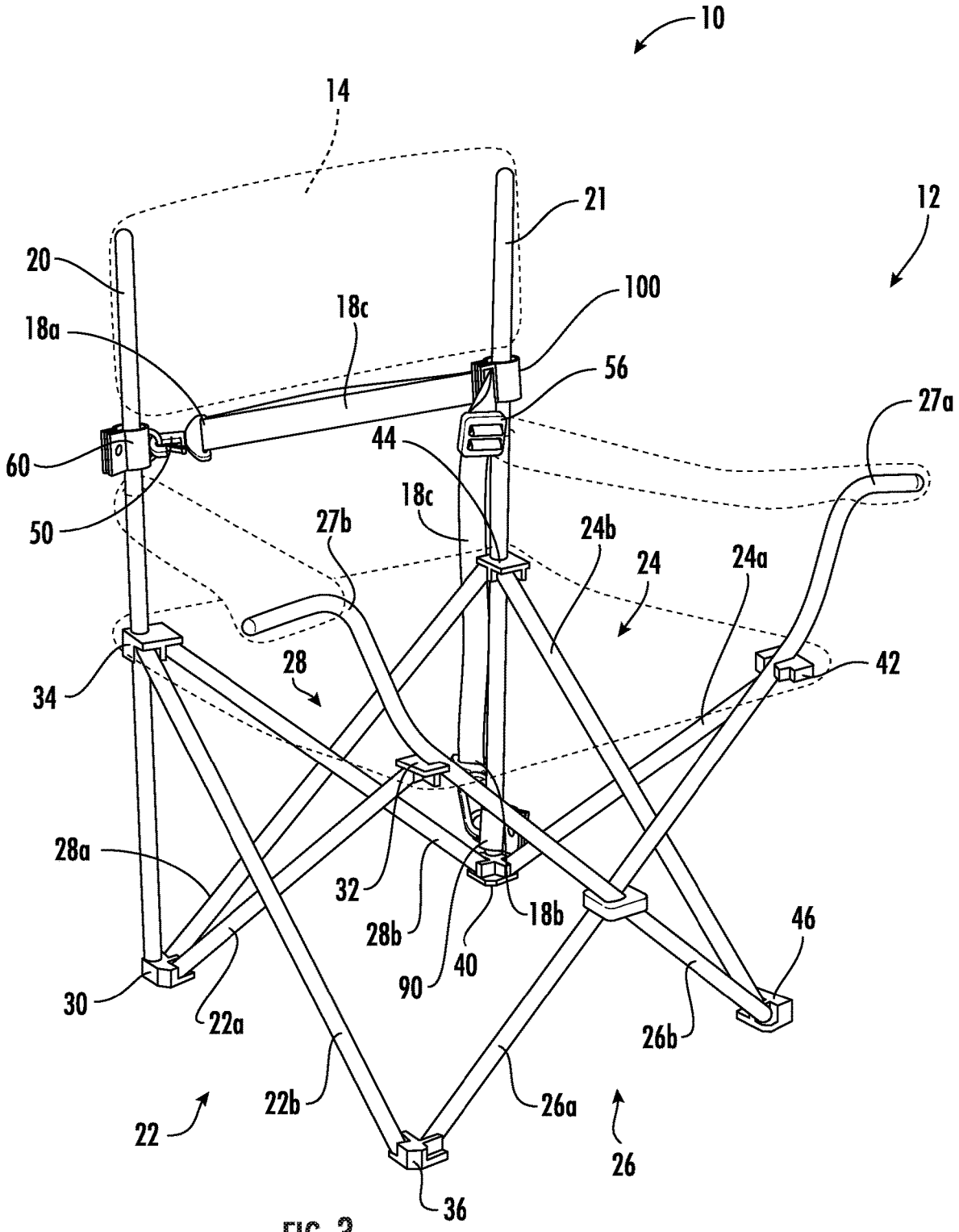
FIG. 3 is a wireframe perspective view of the collapsible chair of FIG. 1 in the expanded state.

FIG. 3 shows a perspective view of an embodiment of the tubular frame 12 and strap arrangement 16 with the cushion fabric element 14 shown in phantom for clarity. With reference to FIGS. 1, 2 and 3, the tubular frame 12 may have the general, known linkage structure of a plurality of linear structural tubes made, for example, of aluminum. In particular, the tubular frame 12 has two rear uprights 20, 21 and four sets of x-shaped, two-part cross-linkages 22, 24, 26 and 28. The cross-linkage 22 has two straight tubes 22*a*, 22*b* rotatably coupled to each other at their respective midpoints. The cross-linkage 24 similarly has two straight tubes 24*a*, 24*b* rotatably coupled to each other at their respective midpoints, the cross-linkage 26 has two straight tubes 26*a*, 26*b* rotatably coupled to each other at their respective midpoints, and the cross-linkage 28 has two straight tubes 28*a*, 28*b* rotatably coupled to each other at their respective midpoints. The tubes 26*a*, 26*b* further include arm extensions 27*a*, 27*b* that extend from the upper end of the respective tubes 26*a*, 26*b*.

The tube 22*a* is rotatably coupled at one end to a rear bottom anchor 30 and at the other end to the floating front anchor 32. The tube 22*b* is rotatably coupled at one end to a rear sliding anchor 34 and at the other end to the front bottom anchor 36. The tube 24*a* is rotatably coupled at one end to the other rear bottom anchor 40 and at the other end to the floating front anchor 42. The tube 24*b* is rotatably coupled at one end to the other rear sliding anchor 44 and at the other end to the front bottom anchor 46. The linkages 22 and 24 define the side structures to the frame 12.

The tube 26*a* is rotatably coupled at one end to the front bottom anchor 36 and is operably coupled at the other end to the floating front anchor 42. The tube 26*b* is rotatably coupled at one end to a front bottom anchor 46 and at the other end to the floating front anchor 32. The tube 28*a* is rotatably coupled at one end to the rear bottom anchor 30 and at the other end to the sliding anchor 44. The tube 28*b* is rotatably coupled at one end to the rear sliding anchor 34 and at the other end to the rear bottom anchor 40. The linkages 26 and 28 thus define the front and rear structures to the frame 12.

The rear sliding anchors 34, 44 are operably coupled in sliding engagement with the rear uprights 20, 21. As shown in FIG. 2, conversion from the expanded state (FIGS. 1 and 3) to the collapsed state involves the bottom anchors 30, 36, 40, 46 moving laterally toward each other, and the anchors 32, 34, 42, 44 moving laterally toward each other. Such movement also causes the sliding anchors 34, 44 to slide up the rear supports 20, 21. The rear supports 20, 21 also move toward each other laterally.

Figure 4:
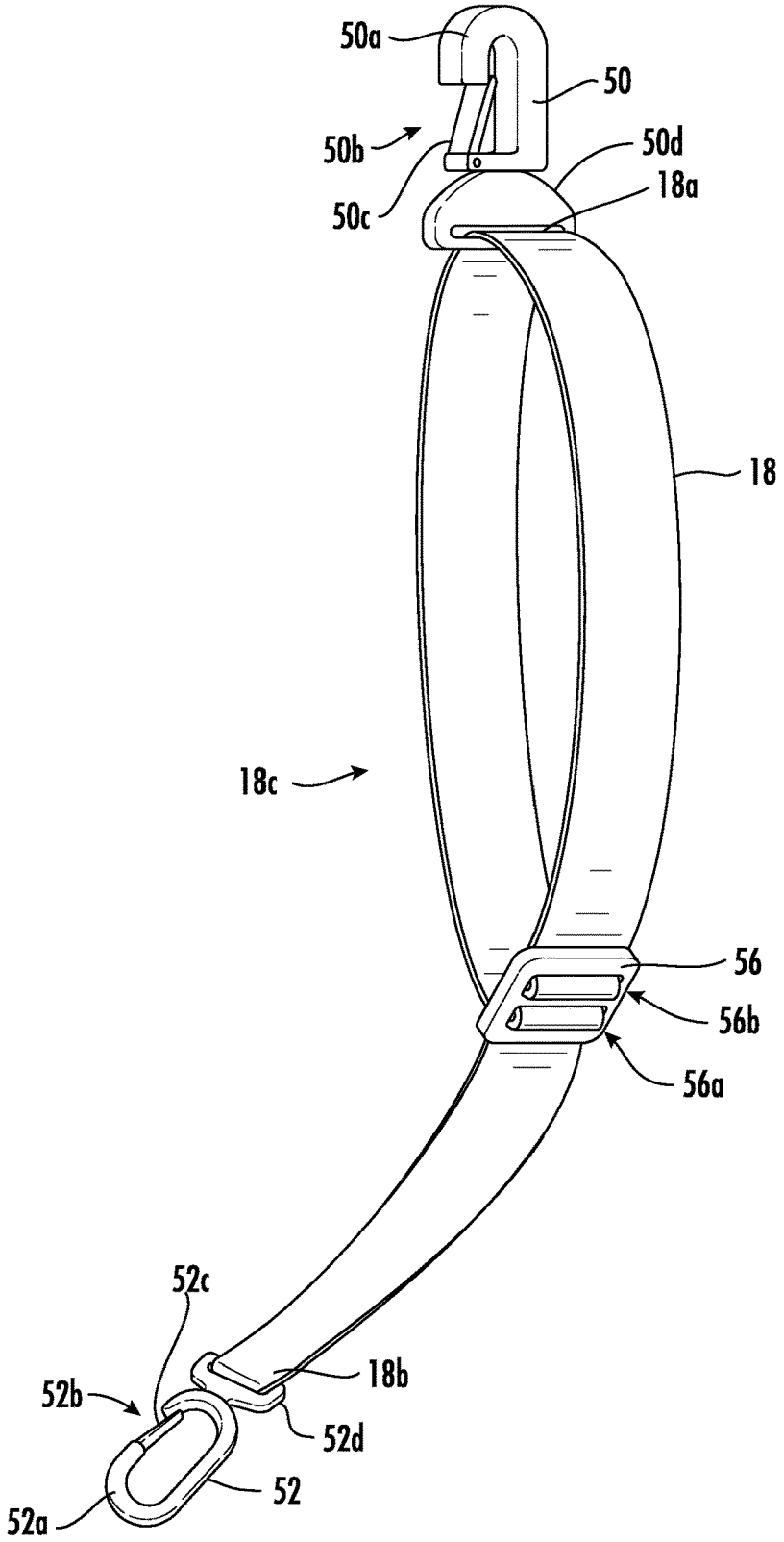
FIG. 4 is an illustration of a strap and associated connectors of the strap arrangement of FIG. 1 shown detached form the collapsible chair.

The strap arrangement 16 includes a strap 18, a first coupling arrangement 60, a second coupling arrangement 90, and a third coupling arrangement 100. The strap 18, illustrated in more detail in FIG. 4, is formed of webbing similar to that material used on luggage, backpacks, and the like. For example, the strap may be formed of nylon, neoprene, canvas, or mesh. The strap 18 may include one or more pads formed of, for example, any desired open or closed cell foam, to enable the strap 18 to rest comfortably on a user's shoulder.

The strap 18 in this embodiment has a first end 18*a* coupled to a first connector 50, a second end 18*b* coupled to a second connector 52, and an intermediate portion 18*c* that extends in a flexible manner therebetween and that includes a strap adjuster 56. The first and second connectors 50, 52 may each include, for example, an open hook structure 50*a*, 52*a* defining an open end 50*b*, 52*b* that is closed by a pivotable clasp 50*c*, 52*c*. Each of the first and second connectors 50, 52 may also include a respective closed loop 50*d*, 52*d* coupled to the respective hook structure 50*a*, 52*a*. The second end 18*b* of the strap 18 wraps through and around the closed loop 52*d*, and may suitably be doubled back and stitched to itself to form a looped connection to the closed loop 52*d*. The first end 18*a* of the strap 18 in this embodiment similarly wraps through and around the closed loop 50*d*, but is instead coupled to the strap adjuster 56 to form a looped connection to the closed loop 50*d*. The reader should appreciate, however, that other suitable connectors may be used in place of the hook and clasp structures.

In this embodiment, the strap adjuster 56 defines a first opening 56*a* and a second opening 56*b*, through which the strap 18 passes. More specifically, the strap 18 runs from the second connector 52, through the first opening 56*a*, loops though the first connector 50, and then passes through the second opening 56*b*, whereat the strap 18 terminates. The strap adjuster 56 can be manually moved toward the first connector 50 to decrease the portion of the strap that is folded over between the strap adjuster and the strap and increase the length of the portion of the strap that is not folded over, thereby increasing the effective length of the strap 18. Conversely, the strap adjuster 56 can be manually moved away from the first connector 50, thereby decreasing the length of the portion of the strap between the strap adjuster 56 and the second end 18*b* and increasing the length of the strap that is folded over between the strap adjuster 56 and the first end 18*a*, thus decreasing the effective length of the strap 18.

The first end 18*a* is anchored to the fixed upright 20 with a first coupler or coupling arrangement 60 that is fixed vertically at a location that is approximately two-thirds the distance from the bottom of the rear upright 20 to the top of the rear upright 20. The location of the first coupling arrangement 60 is chosen so as not to interfere with the sliding travel of the sliding anchor 34, and so as not to interfere with features of the cushion/seat/back element 14 that couple (i.e. extend over) the rear upright 20. The reader should appreciate that the location of the first coupling arrangement 60 may be different depending on the configuration of the chair 10, in particular the cushion/seat/back element 14 and the sliding anchor 34.

Figure 5:
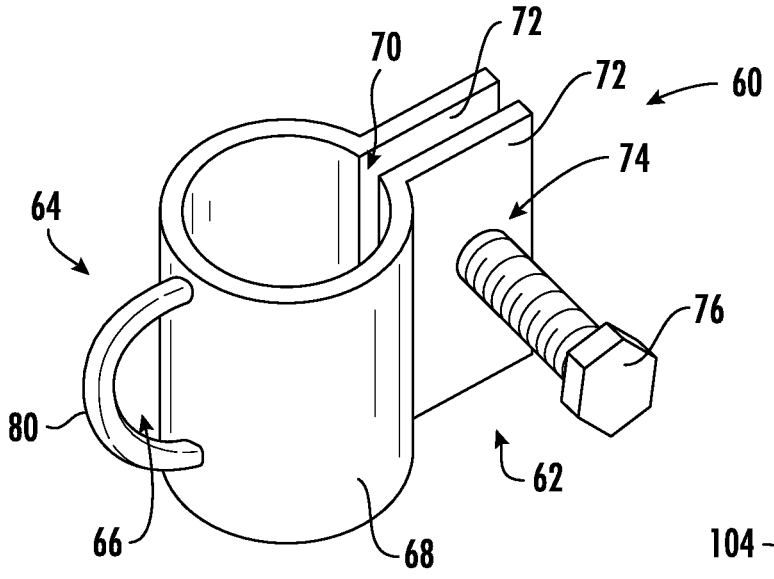
FIG. 5 is a perspective view of a coupling arrangement of the strap arrangement of FIG. 1.

FIG. 5 illustrates one particular embodiment of the first coupling arrangement 60. The first coupling arrangement 60 includes a clamp portion 62 and a loop portion 64 that defines a closed opening 66. The clamp portion 62 is formed by a circular-cylindrical member 68 with an open side 70, and two flanges 72 protruding from the ends of the circular-cylindrical member 68 at the open side 70. The circular-cylindrical member 68 is sized so as to fit over the tubular rear upright 20. Additionally, the circular-cylindrical member 68 is resiliently flexible such that the open side 70 can be expanded by moving the two flanges 72 away from one another such that the flanges 72 and the open side 70 fit over the rear upright 20. Once the rear upright 20 is positioned in the circular-cylindrical member 68, the circular-cylindrical member 68 is closed so as to clamp the circular-cylindrical member 68 to the rear upright 20.

Each flange 72 includes an opening 74 (only one is visible in FIG. 5) through which a clamping fastener 76 passes. One of the openings 74 may be a threaded opening, and the clamping fastener 76 may be a threaded member, for example a bolt or screw, that is threaded into the threaded opening so as to clamp the two flanges 72 to one another to fasten the first coupling arrangement 60 to the rear upright 20. In one particular embodiment, the clamping fastener 76 does not require use of tools to tighten, such as for example a thumb screw or hand wheel, so that the user can install the first coupling arrangement 60 without needing tools.

In another embodiment, the clamp portion 62 may include a different clamping mechanism that is capable of closing the open side 70 of the circular-cylindrical member 68 and tightening the circular-cylindrical member 68 around the rear upright 20, for example a clasp, a hook and loop arrangement, a strap, or an adhesive. In yet another embodiment, the circular-cylindrical member 68 may be directly affixed to the rear upright 20 by, for example, a fastener that passes through a hole in the rear upright 20.

The loop portion 64 of the first coupling arrangement 60 includes a loop 80 attached at both ends to the circular-cylindrical portion 68 so as to form the closed opening 66. In particular, the ends of the loop 80 are vertically aligned with one another such that the loop 80 is defined in a vertical plane that passes through the longitudinal axis of the rear upright 20. In the illustrated embodiment, the loop 80 is arcuate, though the reader should appreciate that any shape of loop may be used to define the closed opening 66. In another embodiment, the loop 80 may be configured to selectively open and close via, for example, a clasp or latch, to enable attachment of the strap 18 via the connector 50. In the embodiment of the strap 18 of FIG. 4, the first connector 50 is coupled to the loop 80 via the hook 50*a* and clasp 50*c*.

Figure 8:
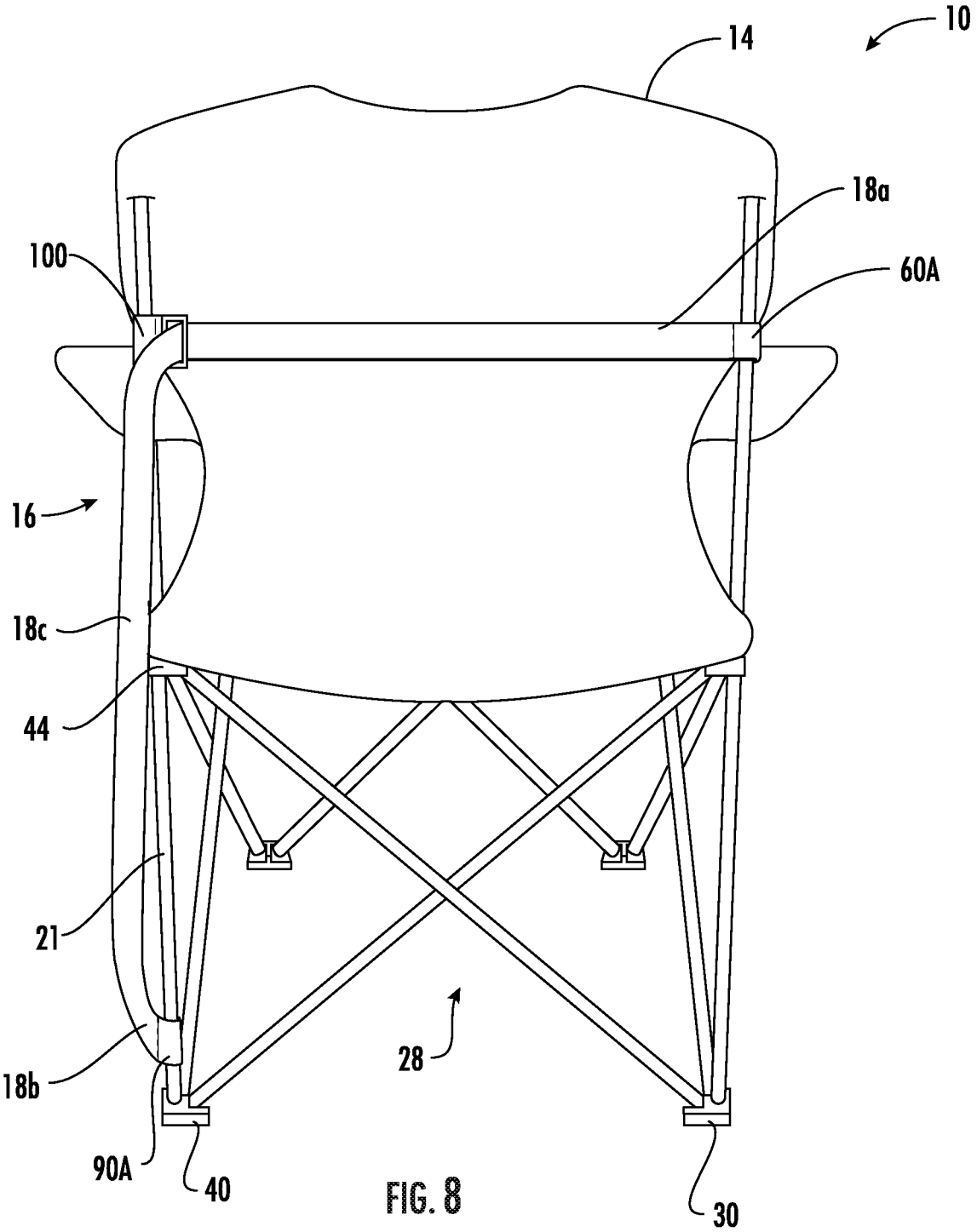
FIG. 8 is a rear view of a collapsible chair in the expanded that has another strap arrangement according to the disclosure.

It will be appreciated that the first coupling arrangement 60 may be configured differently than depicted in FIG. 5, as the first end 18*a* of the strap 18 may be coupled to the rear upright 20 in any suitable manner. For example, in another embodiment, the first end 18*a* of the strap may be wrapped around and/or coupled to a ring or grommet that is, in turn coupled at a predetermined location on the rear upright 20. The ring may be pivotally coupled to a pin or the like that extends through an opening in the rear upright, for example. Other methods of coupling the first end 18*a* of the strap 18 to the rear upright 20 may be employed. For example, as depicted in FIG. 8, the first coupling arrangement 60A may consist of a portion of the first end 18*a* of the strap 18 that is wrapped around the rear upright 20 and affixed to the strap 18 so as to form a closed loop around the rear upright 20.

Referring back to FIGS. 1-3, the second end 18*b* of the strap 18 is coupled to the bottom of the opposite rear upright 21 adjacent to the rear bottom anchor 40 via a second coupler or coupling arrangement 90. In some embodiments, the second coupling arrangement 90, 90A is substantially identical to the first coupling arrangement 60, 60A. The reader should appreciate, however, that the second end 18*b* may be coupled to the rear upright 21 in a different manner than the first coupling arrangement 60.

Additionally, with reference back to FIG. 4, it will be appreciated that, in some embodiments, the strap 18 may be configured such that the first and second ends 18*a*, 18*b* are interchangeable. In other words, either the first end 18*a* or the second end 18*b* may be connected to the first coupling arrangement 60, while the other end 18*b*, 18*a* is connected to the second coupling arrangement 90. Alternatively, the strap 18 may be designed such that one end of the strap 18 is configured to attach only to the first coupling arrangement 60, while the other end of the strap 18 is configured to attach only to the second coupling arrangement 90.

The intermediate portion 18*c* of the strap 18 extends through a third coupling arrangement 100 that is operably coupled to the rear upright 21 at a vertical location that is above the vertical location at which the second end 18*b* is coupled to the rear upright 21. In the illustrated embodiment, the third coupling arrangement 100 is configured as a loop structure that is coupled in a vertical location that is above the sliding range of motion of the sliding anchor 44, and preferably at a comparable vertical level to that of the first coupling arrangement 60.

Figure 6:
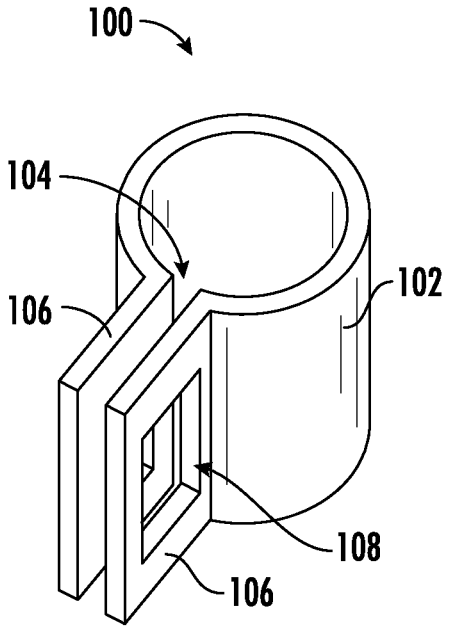
FIG. 6 is a perspective view of a coupling arrangement or loop structure of the strap arrangement of FIG. 1.

One embodiment of the third coupling arrangement 100 is illustrated in greater detail in FIG. 6. The third coupling arrangement 100 includes a circular-cylindrical member 102 defining an open side 104 and two flanges 106 projecting from end sides of the circular-cylindrical member 102 at the open side 104. The circular-cylindrical member 102 has a diameter sufficient to receive the rear upright 21 therethrough, with sufficient spring bias to hold the member 102 in place on the rear upright 21.

Each of the flanges 106 is formed as a loop structure defining a respective through opening 108 sized to enable the strap 18 to pass through the through opening 108. In some embodiments, the through opening 108 may be sized such that the strap adjuster 56 cannot pass through the opening 108.

The third coupling arrangement 100 may suitably be constructed as a single monolithic structure formed of a polymer (plastic) by, for example injection molding, such that the circular-cylindrical member 102 and the flanges 106 are integral with one another. In this embodiment, the circular-cylindrical member 102 is elastically resilient such that the two flanges 106 can be separated from one another to increase the size of open side 104 so that the third coupling arrangement 100 can be installed on the rear upright 21 with the circular-cylindrical member 102 substantially encompassing the circumference of the rear upright 21.

In other embodiments, the third coupling arrangement 100 may be a polymer (plastic) or other rigid loop having a central opening that is either round, or roughly shaped in the same manner as the cross-section of the strap 18. The third coupling arrangement may be attached to the rear upright 21 in a pivoting manner, or rigidly. The third coupling arrangement in some embodiments has a locking mechanism that allows the strap 18 to be locked into the positions shown in FIG. 2 (and FIG. 1 if desired). Various looped structures that include a tightening feature are well known.

Figure 9A:
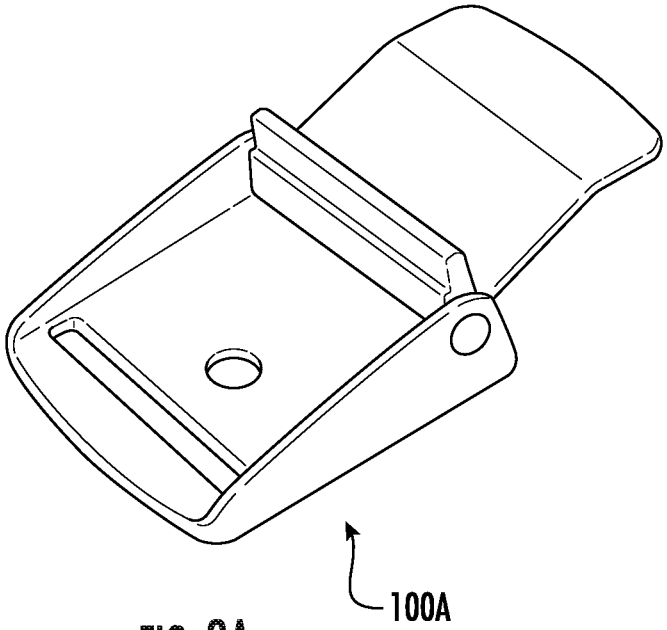
FIG. 9A is a perspective view of a locking loop mechanism for the strap arrangement of FIG. 1, shown in the open position.
Figure 9B:
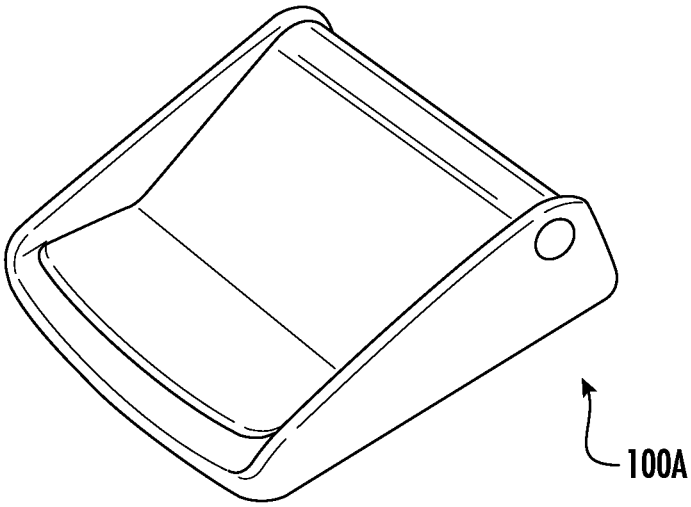
FIG. 9B is a perspective view of the locking loop mechanism of FIG. 9A shown in the closed position.

FIGS. 9A and 9B show one example of such a locking loop mechanism 100A that consists of a back plate and a rotating camming lock plate that allows the strap 18 to move in the open position, but creates a friction lock on the strap 18 when in the closed position. The locking loop mechanism 100A is shown in FIG. 8A in the open position, and in FIG. 8B in the closed position. The locking mechanism 100A helps maintain the chair 10 in the collapsed state during carrying. In particular, the strap 18 is locked in a position that helps hold the uprights 20, 21 close to each other.

Referring again to the embodiment of FIG. 6, the intermediate portion 18*c* of the strap 18 is fed through the third coupling arrangement 100 in such a way that the intermediate portion 18*c* may slide back and forth through the third coupling arrangement 100. In some embodiments, the strap 18 is sized such that, when the chair 10 is in the expanded position as shown in FIGS. 1 and 3, the strap 18 extends with a relatively small amount of slackness. In other words, when extended to its longest effective length, the strap 18 has a length that is roughly equal to the sum of the distance between the first coupling arrangement 60 and the third coupling arrangement 100, and the distance between the third coupling arrangement 100 and the second coupling arrangement 90.

When the chair 20 is collapsed from the expanded state to the collapsed state, the distance between the upright structures 20, 21 is reduced, thereby creating slack in the intermediate portion 18*c* of the strap 18. The user can pull the slack through the third coupling arrangement 100 such that substantially all of the slack is disposed between the third coupling arrangement 100 and the location at which the second end 18*b* is attached to the rear upright 21. This slack forms the shoulder strap for carrying. FIG. 2 shows the strap 18 configured as a shoulder strap for carrying the chair 10 in the collapsed state. If there is too much slack in the strap for the user to comfortably carry the chair 10, the user may adjust the effective length of the strap 18 using the strap adjuster 56.

Figure 7:
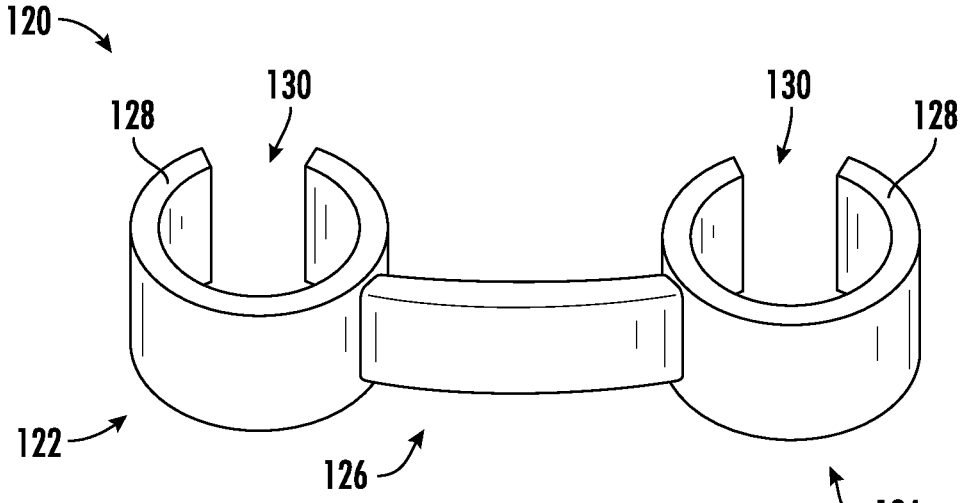
FIG. 7 is a perspective view of a retaining device of the strap arrangement of FIG. 1.

FIG. 7 illustrates a retaining device 120 for the chair 10 that may optionally be part of the strap arrangement 16 or used in conjunction with the strap arrangement 16. The retaining device 120 is a double-sided snap clip that snaps onto adjacent tubes of the frame 12 when the frame 12 is collapsed as shown in FIG. 2. In this embodiment, the retaining device 120 includes a first upright attachment portion 122, a second upright attachment portion 124, and a connecting portion 126. The first and second upright attachment portions 122, 124 are circular-shaped arc portions 128 having an open end 130, and are elastically resilient such that the circular-shaped arc portions can be enlarged to pass over the respective upright 20, 21. The circular-shaped arc portions 128 are sized such that upon passing over the respective upright 20, 21, the circular arc-shaped portions 128 snap fit to the respective upright 20, 21 to prevent the respective upright 20, 21 from passing back through the open end 130 without applying force to the circular arc-shaped portions 128 to expand the circular arc-shaped portions 128 by, e.g., manually separating the circular arc-shaped portions 128 from the rear uprights 20, 21.

The connecting portion 126 is sized to be approximately the distance between the rear uprights 20, 21, when the chair is in the collapsed state. Thus, when the chair 10 is in the collapsed state, the user attaches the retaining device 120 to the rear uprights 20, 21. The retaining device 120 prevents the rear uprights 20, 21 from separating from one another and causing the chair 10 to expand while the user is carrying the chair 10 by the strap 18.

In one embodiment, the strap arrangement 16 is configured to assist the user in collapsing the chair. In such an embodiment, the strap 18 is arranged such that the second end 18*b* is connected to the first coupling arrangement 60, and the first end 18*a* is connected to the second coupling arrangement 90. The strap adjuster 56 may be arranged in the intermediate portion 18*c* of the strap 18 between the third coupling arrangement 100 and the second coupling arrangement 90 in such a way that the strap adjuster 56 cannot pass through the third coupling arrangement, or it may be fixedly attached to the third coupling arrangement 100.

To collapse the chair 10, the user pulls on the strap 18 in the region between the strap adjuster 56 and the first coupling arrangement 60, thereby reducing the length of the portion of the strap between the strap adjuster 56 and the first coupling arrangement 60 and decreasing the effective length of the strap 18. Since the strap adjuster 56 is restrained from moving toward the first coupling arrangement 60, the reduction in the length of the portion of the strap 18 between the strap adjuster 56 and the first coupling arrangement 60 causes the strap 18 to pull the first coupling arrangement 60 towards the third coupling arrangement 100. As a result, the rear uprights 20, 21 are pulled towards one another, thereby collapsing the chair 10.

Moreover, even though the overall effective length of the strap 18 decreases, since the amount of the strap 18 between the strap adjuster 56 and the second coupling arrangement 90 necessarily increases, the strap 18 provides slack between the second and third coupling arrangements 90, 100 that enables the user to carry the chair 10. Once the user has pulled the strap 18 such that the chair 10 is in the fully collapsed state, the user may attach the retaining device 120 to the rear uprights 20, 21 to keep the chair 10 in the fully collapsed state.

The embodiment described herein thus provides a way to collapse a chair 10 and carry the chair 10 using a strap arrangement 16 without having to place the collapsed chair 10 into a separate bag. The strap arrangement 16 is lightweight, and does not interfere with the use of the chair 10 when in the expanded state. Moreover, the user may easily get up, collapse and move the chair 10 to another location, and set up the chair 10 at the new location. Additionally, the strap arrangement 16 may be simply and quickly retrofitted onto an existing collapsible chair 10. The chair 10 may optionally be also used with the prior art storage bag, not shown, when put away during non-use.

It will be appreciated that the above-described embodiments are merely exemplary, and that those of ordinary skill in the arm may readily devise their own implementations and modifications that incorporate the principles of the present invention and fall within the spirit and scope thereof.

The invention claimed is:

1. A strap arrangement for a collapsible chair, the strap arrangement comprising:

a first coupling arrangement configured to fixedly attach to a first rear upright of the collapsible chair;

a second coupling arrangement configured to fixedly attach to a second rear upright of the collapsible chair;

a third coupling arrangement configured to attach to the second rear upright; and a strap having a first end attached to the first coupling arrangement, a second end attached to the second coupling arrangement, and an intermediate portion that passes through and is slidable relative to the third coupling arrangement;

wherein the third coupling arrangement is configured as a loop structure defining an opening through which the intermediate portion of the strap extends; and wherein the third coupling arrangement includes a circular-cylindrical member configured to clamp to the second rear upright.

2. The strap arrangement of claim 1, further comprising a snap clip configured to snap connect to each of two tubes of a frame of the collapsible chair.

3. The strap arrangement of claim 2, wherein the snap clip comprises a double-sided snap clip that is configured to snap onto adjacent tubes of the frame when the frame is in a collapsed state.

4. The strap arrangement of claim 1, wherein the strap includes a strap adjuster that adjusts an effective length of the strap.

5. The strap arrangement of claim 4, wherein the strap is configured such that reducing the effective length of the strap causes the first and second rear uprights to move closer to one another, thereby causing the collapsible chair to move from an expanded state to a collapsed state.

6. The strap arrangement of claim 5, wherein each of the first and second coupling arrangements includes a clamping portion configured to clamp to the respective one of the first and second rear uprights and an attachment portion configured to attach to the respective one of the first and second ends of the strap.

7. The strap arrangement of claim 6, wherein each of the clamping portions includes a circular-cylindrical member configured to clamp to the respective one of the first and second rear uprights.

8. The strap arrangement of claim 7, further comprising a retaining device having a first portion configured to attach to the first rear upright and a second portion configured to attach to the second rear upright, the retaining device configured to retain the collapsible chair in the collapsed state.

9. The strap arrangement of claim 1, wherein each of the first and second coupling arrangements includes a clamping portion configured to clamp to the respective one of the first and second rear uprights and an attachment portion configured to attach to the respective one of the first and second ends of the strap.

10. A collapsible chair comprising:

a collapsible frame having a first rear upright and a second rear upright; and a strap arrangement comprising, a first coupler fixedly attached to the first rear upright;

a second coupler fixedly attached to the second rear upright;

a third coupler attached to the second rear upright; and a strap having a first end attached to the first coupling arrangement, a second end attached to the second coupling arrangement, and an intermediate portion that passes through and is slidable relative to the third coupling arrangement.

11. The collapsible chair of claim 10, wherein the third coupler includes an opening through which the intermediate portion of the strap extends.

12. The collapsible chair of claim 11, wherein the third coupler includes a circular-cylindrical member clamped to the second rear upright, and two flanges defining an opening through which the strap passes.

13. The collapsible chair of claim 12, wherein the strap includes a strap adjuster that adjusts an effective length of the strap.

14. The collapsible chair of claim 13, wherein the strap is configured such that reducing the effective length of the strap causes the first and second rear uprights to move closer to one another, thereby causing the collapsible chair to move from an expanded state to a collapsed state.

15. The collapsible chair of claim 14, wherein each of the first and second couplers includes a clamping portion clamped to the respective one of the first and second rear uprights and an attachment portion attached to the respective one of the first and second ends of the strap.

16. The collapsible chair of claim 15, wherein each of the clamping portions includes a circular-cylindrical member clamped to the respective one of the first and second rear uprights.

17. The collapsible chair of claim 16, further comprising a retaining device having a first portion configured to attach to the first rear upright and a second portion configured to attach to the second rear upright, the retaining device configured to retain the collapsible chair in the collapsed state.

18. The collapsible chair of claim 10, wherein the collapsible frame comprises a plurality of tubes, and further comprising a snap clip configured to snap connect to each of two tubes of the collapsible frame.

* * * * *